US007014098B1

(12) United States Patent
Hauser

(10) Patent No.: US 7,014,098 B1
(45) Date of Patent: Mar. 21, 2006

(54) ODORANT AND MARKER CAPSULE FOR DETERRING MAILBOX VANDALISM

(76) Inventor: Ray L Hauser, 5758 Rustic Knolls Dr., Boulder, CO (US) 80301

( * ) Notice: Subject to any disclaimer, the term of this patent is extended or adjusted under 35 U.S.C. 154(b) by 135 days.

(21) Appl. No.: 10/867,367

(22) Filed: Jun. 14, 2004

(51) Int. Cl.
*B65D 91/00* (2006.01)

(52) U.S. Cl. ..... 232/38; 232/17

(58) Field of Classification Search ..... 232/38, 232/17; 109/34, 25, 31
See application file for complete search history.

(56) References Cited

U.S. PATENT DOCUMENTS 4,368,842 A * 1/1983 DeLange, III ..... 232/17
4,375,869 A * 3/1983 Hatch ..... 232/17
4,905,892 A * 3/1990 Fischer ..... 232/17
5,067,650 A 11/1991 Jones et al.
5,208,085 A * 5/1993 Pace ..... 428/43
5,435,483 A * 7/1995 Cox ..... 232/38
5,460,326 A * 10/1995 Albanesius ..... 232/39
D385,679 S * 10/1997 Sullivan ..... D99/29

OTHER PUBLICATIONS

"Make it stink"; http://216.22.178.73/_disc/0000004c.htm Feb. 10, 2003.

* cited by examiner

*Primary Examiner*—William L. Miller
(74) *Attorney, Agent, or Firm*—David Kiewit

(57) ABSTRACT

Mailbox vandalism is deterred by depositing a noxious material on a tool or weapon used by a vandal to smash a mailbox. The noxious material may be provided in a capsule fastened to a traffic-facing side of the mailbox so that a vandal's blow directed at the mailbox succeeds in fracturing the capsule and coating the vandal's tool or weapon with a noxious material. The capsule or capsules may contain any of a variety of malodorants, colorants, irritants and adhesives. The overall container may be configured as a composite capsule in which the noxious material is held within an inner glass capsule protected from environmental and accidental damage by a surrounding, relatively easily broken, outer capsule directly fastened to the protected mailbox.

8 Claims, 2 Drawing Sheets

ODORANT AND MARKER CAPSULE FOR DETERRING MAILBOX VANDALISM

BACKGROUND OF THE INVENTION

1. Field of the Invention

The invention relates to apparatus and method for deterring vandalism by coating a vandal's tool or weapon with a viscous and persistently malodorous substance. This apparatus is particularly useful for deterring the destruction of roadside mailboxes by vandals.

2. Background Information

"Mailbox baseball" is a form of vandalism in which a passenger in a vehicle leans out and swings a bat, or other striking tool, at a mailbox as the car drives along the road. Rural mailboxes are particularly susceptible to such vandalism, but the problem sometimes occurs in urban neighborhoods where post-mounted mailboxes are placed at curbside. Numerous inventors, handymen, and mailbox manufacturers have addressed this problem by providing impact-resistant mailboxes, and resilient or strengthened mailbox supports.

Jones et al., in U.S. Pat. No. 5,067,650 disclose a mailbox cover enclosing a reservoir holding a non-toxic dye and arranged to expel the dye towards the front of the mailbox when the cover receives a downwardly directed crushing blow.

BRIEF SUMMARY OF THE INVENTION

The invention provides a means of deterring mailbox vandalism by depositing a malodorous coating on a bat or other tool or weapon used to smash a mailbox. In a preferred embodiment, a malodorant capsule is fastened to a traffic-facing side of the mailbox so that a vandal's blow directed at the mailbox succeeds in fracturing the capsule and coating the vandal's tool or weapon with a noxious material. This capsule is preferably readily attachable to the mailbox in a position in which it is particularly vulnerable to more or less horizontally directed blow on the traffic-facing side of the mailbox. In some embodiments, multiple such capsules can be placed on a single mailbox in order to ensure that at least one of them is broken by a vandal's attack.

Preferred embodiments of the invention provide a composite capsule in which the malodorant is held within and wets an internal surface of a sealed glass tube that is, in turn, disposed within an outer tube preferably formed from a relatively thin and brittle plastic material selected so that it shields the contents of the inner tube from sunlight.

A preferred embodiment of the invention is operable over a wide temperature range and comprises a solution of mercaptan compounds in solvents selected to ensure that the contents of the capsule remain liquid in below freezing temperatures.

Although it is believed that the foregoing rather broad recital of features and technical advantages may be of use to one who is skilled in the art and who wishes to learn how to practice the invention, it will be recognized that the foregoing recital is not intended to list all of the features and advantages. Those skilled in the art will appreciate that they may readily use both the underlying ideas and the specific embodiments disclosed herein as a basis for designing other arrangements for carrying out the same purposes of the present invention. Those skilled in the art will realize that such equivalent constructions are within the spirit and scope of the invention in its broadest form. Moreover, it may be noted that various embodiments of the invention may provide various combinations of the hereinbefore recited features and advantages of the invention, and that less than all of the recited features and advantages may be provided by some embodiments.

DETAILED DESCRIPTION OF THE INVENTION

In studying this Detailed Description, the reader may be aided by noting definitions of certain words and phrases used throughout this patent document. Wherever those definitions are provided, those of ordinary skill in the art should understand that in many, if not most instances, such definitions apply to prior, as well as future uses of such defined words and phrases. At the outset of this Description, one may note that the terms "include" and "comprise," as well as derivatives thereof, mean inclusion without limitation; the term "or," is inclusive, meaning and/or; the word "bat" stands for any sort of elongated tool or weapon usable by a vandal to smash a mailbox and shall include, but not be limited to, such implements as a baseball bat, a club or mace, a stick, a piece of lumber, an ax, a sword, or a hammer; the word "post" shall stand for any sort of vertically extensive ground anchoring support for a mailbox and shall include without limit such things as a conventional lumber post, a concrete or stone pillar and a metal structural element; "malodorant" shall stand for any sort of material having an odor generally perceived to be noxious and unpleasant, whether that material is colored or colorless; "colorant" shall stand for materials colored by pigment particles or by dyes, regardless of whether the colorant material is odorless or scented.

Figure 1:
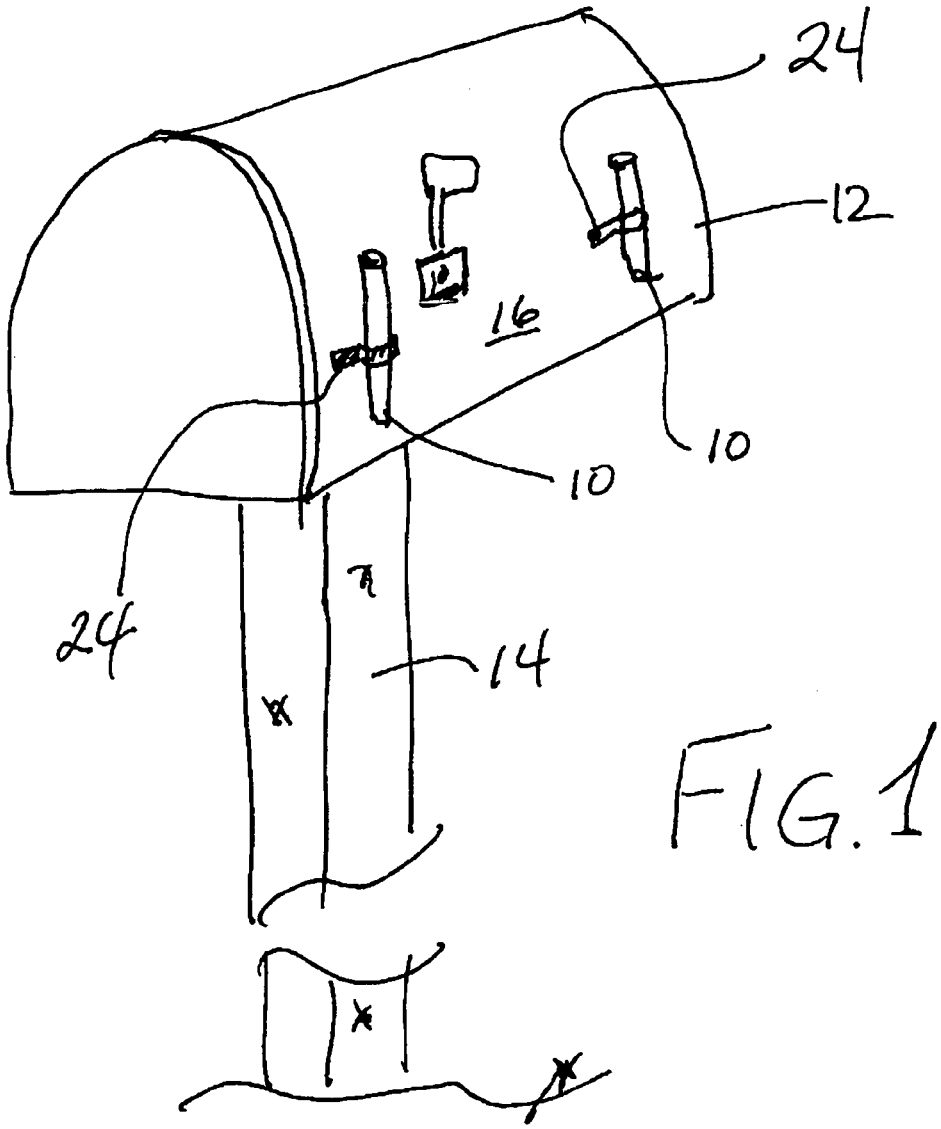
FIG. 1 is a partly cut away elevational view of a capsule of the invention attached to a mailbox.
Figure 2:
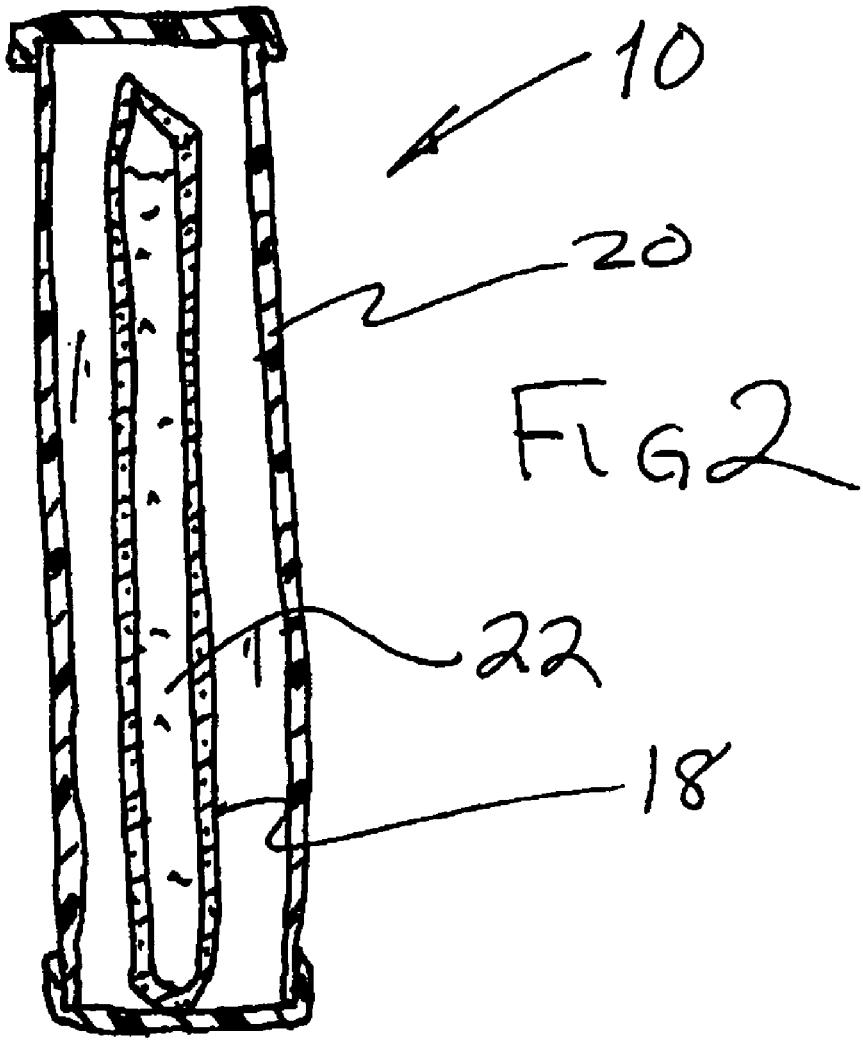
FIG. 2 is a cross-sectional view of the capsule of FIG. 1.

Turning now to FIG. 1, one finds a malodorant capsule 10 of the invention attached to a mailbox 12 of the sort that is ordinarily mounted on a post 14 along a roadway. As is conventional, the mailbox 12 has a traffic-facing side 16 with a flag 19 movably attached to it. This traffic-facing side of the mailbox is commonly the target of a bat-swinging vandal in a moving vehicle, and the most common attack involves a bat swung nearly horizontally against the mailbox. Hence, the capsule 10 is generally attached to the traffic facing side of the mailbox in a vertical orientation in order to maximize the chance that it will be broken by a vandal's blow. In some installations multiple capsules can be used to further increase the likelihood of successfully coating a vandal's bat with a noxious substance. The reader will realize that in some circumstances a vandal's attack can be launched against a top of the box—e.g., when the vandal is on foot. If such an assault is deemed likely, one can select another portion of the exterior surface of the mailbox for protection and install a capsule so as to protect that selected portion of the mailbox instead of, or in addition to, the traffic-facing side.

A preferred capsule 10 for a noxious liquid is a composite structure comprising a sealed inner capsule 18 disposed within a sealed outer capsule 20. In this arrangement the outer capsule 20 can provide protection against accidental breakage during shipping, handling and service. The reader will recognize that particular choices of materials and their thicknesses influence the ease with which the capsule 10 can be broken, and that some compromise is necessary to provide a capsule readily broken by a vandal's bat that is still sturdy enough to be shipped and installed without too great a chance of accidental breakage.

In many embodiments, the inner capsule 18 is made of glass. In addition to being easily broken, glass also provides an impermeable and inert container ideally suited for holding many of the malodorant compounds. A glass inner capsule 18 may be sealed by means of a glass weld joint, a threaded end cap, an adhesively bonded cap, or any other known means suitable for providing a sealed container for storing the malodorant for extended periods of time. The reader will appreciate that although glass is the generally preferred material, one could use any of many other materials, which include, but are not limited to, ceramics or plastics selected for their brittle behavior or for their ability to be used as thin and easily ruptured membranes.

A selected amount of noxious liquid 22 is retained in the sealed inner capsule 18 so as to wet an inner surface thereof. In preferred embodiments, the inner capsule 18 is only partially filled, leaving an air space that allows the noxious liquid to expand as the service temperature increases without excessively raising the internal pressure in the capsule.

In preferred embodiments the inner capsule 18 is closely retained within an outer capsule 20 made of a material selected to allow the outer capsule to fracture or rupture under a severe impact, such as would be expected from a vandal's bat. As noted above, the outer capsule 20 is also selected to be strong enough to provide some degree of protection to the inner capsule when the composite structure is shipped in commerce and when it is exposed to modest and incidental contact during service. In a particular preferred embodiment, the outer capsule 20 comprises an acrylic plastic tube having a wall thickness of 0.020 to 0.040 inches.

Many materials that might be selected for use in the noxious liquid 22 decompose when exposed to ultraviolet light. Hence, when using a glass inner tube, some sort of shielding is desired to prohibit or to at least substantially reduce the amount of light reaching the noxious liquid if the capsule of the invention is to be used for extended periods of time. Solar shielding can be provided in many ways including, but not limited to, the use of a UV-blocking coating on a surface of either the inner or outer tube, or the use of an optically opaque material for fabricating either or both of the outer and inner tubes. In a particular preferred embodiment, a black, carbon-filled acrylic material is used for the outer tube 20.

The noxious liquid may comprise a combination of malodorants, irritants, colorants, and adhesives. Prospective malodorants include, but are not limited to, chemicals such as ammonium carbonate, ammonium sulfide, capryl alcohol, caprylic acid and mercaptans such as butyl mercaptan (which is a variation of natural skunk oil). Prospective irritants include, but are not limited to, oleoresin capsicum (the active ingredient of pepper spray) and mace (2-chloroacetophenone). Colorants may comprise ordinary food coloring and pigments or materials having a special fluorescent or phosphorescent characteristic. Adhesives may comprise water-soluble polymers with sticky characteristics so as to cause any of the malodorants, irritants and colorants to adhere to a vandal's bat. Materials of this sort that are appropriate for addition to the liquid include polyvinylpyrrolidone, polyvinyl alcohol, starch, carboxymethylcellulose, mucilage and a variety of natural gums, with preservatives as needed. For a non-aqueous formulation, viscous and tacky polyols and polybutenes are appropriate adhesive-like materials.

In one particular preferred embodiment a mixture of t-butyl mercaptan and 1-octyl mercaptan is used in the noxious liquid. The first of these has a relatively high vapor pressure, which indicates a strong, but rapidly dissipated odor; while the latter evaporates more slowly. Thus, the mixture provides for both an initial intense stench as well as a less intense odor that persists for a considerable period so as to increase the vandal's chance of transferring some of the noxious material onto the inside of his or her vehicle. Mixtures of this sort are usable over a wide temperature range and can be used in sub-freezing weather conditions.

For all-weather use, a preferred base noxious liquid 22 is formulated so that it will not freeze during use at expected temperatures. Water plus an antifreeze with a freezing temperature below zero degrees Fahrenheit is suitable for most ambient conditions. Ethanol, propylene glycol and glycerol are appropriate alcohols to use as anti-freeze, the latter two having greater permanence in regard to evaporation.

Light motor oil or kerosene is an appropriate solvent system for mercaptans and polyols where mercaptans are used as odorants.

In a preferred method of the invention, the composite capsule 10 is attached to an exterior, traffic-facing side of a mailbox 12 by means of a suitable fastener 24, which may be any of a wide variety of known fasteners. In one embodiment the fastener 24 comprises one or more flexible plastic clips having a plastic foam and adhesive adhered to a bottom thereof and arranged so that a user can simply peel a protective cover off the foam adhesive, adhere the clip to the mailbox and then push the capsule 10 into the clip. In another embodiment, a metal clip, is held to the mailbox by means of a screw and springably retains the capsule. In yet other embodiments, small attachment ears integrally formed with the external plastic tube 20 may be used with adhesive or mechanical fasteners to hold the capsule to the mailbox. Those skilled in the art will recognize that many other equivalent fastening approaches could be considered.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

I claim:

1. Apparatus comprising a combination of:

a mailbox having an exterior surface with a flag movably attached;

a noxious liquid comprising at least a malodorant disposed within a composite capsule comprising a sealed inner glass tube having an inner surface wetted by the noxious liquid; the inner glass tube disposed within a sealed outer tube; and a fastener attaching the composite capsule to the exterior surface of the mailbox.

2. The apparatus of claim 1 wherein the outer tube comprises means to substantially reduce an amount of light reaching the noxious liquid.

3. The apparatus of claim 1 wherein the noxious liquid further comprises at least one of a colorant, an irritant and an adhesive.

4. The apparatus of claim 1 wherein the noxious liquid has a freezing temperature lower than the freezing temperature of water.

5. A method of deterring a vandal who uses a bat to strike a traffic-facing surface of a first mailbox disposed adjacent a roadway from using the bat to strike a second mailbox, the first mailbox having a flag movably attached thereto the method comprising the steps of:

providing a noxious liquid disposed within a sealed, elongated glass tube; and attaching the glass tube to the traffic-facing surface of the first mailbox before the vandal strikes the first mailbox so that when the vandal strikes the first mailbox with the bat, the glass tube fractures and coats the bat with the noxious liquid;

whereby the vandal is deterred from striking the second mailbox.

6. The method of claim 5 wherein the noxious liquid comprises at least one of: a malodorant; an irritant; a colorant; and an adhesive.

7. The method of claim 5 wherein the glass tube is provided within a sealed plastic tube and is removed therefrom prior to the attaching step.

8. The method of claim 5 wherein the glass tube is permanently disposed within an outer sealed plastic tube, and wherein the step of attaching the glass tube to the first mailbox comprises directly attaching the outer plastic tube to the first mailbox.

* * * * *